US006997574B2

(12) United States Patent
Kotovsky

(10) Patent No.: US 6,997,574 B2
(45) **Date of Patent: *Feb. 14, 2006**

(54) METHOD AND APPARATUS FOR LIGHTING WITH A ONE-PIECE PANEL HAVING A PLURALITY OF HOLES

(76) Inventor: Irwin Kotovsky, 3941 California Ave., Pittsburgh, PA (US) 15212

( * ) Notice: Subject to any disclaimer, the term of this patent is extended or adjusted under 35 U.S.C. 154(b) by 0 days.

This patent is subject to a terminal disclaimer.

(21) Appl. No.: 10/005,255

(22) Filed: Nov. 2, 2001

(65) Prior Publication Data

US 2003/0086258 A1 May 8, 2003

(51) Int. Cl.
*F21S 8/04* (2006.01)

(52) U.S. Cl. ..... 362/147; 362/148; 362/150; 362/404

(58) Field of Classification Search ..... 362/404, 362/434–435, 364, 365, 366, 372, 249, 250, 362/145, 146, 147, 148, 150, 153, 153.1
See application file for complete search history.

(56) References Cited

U.S. PATENT DOCUMENTS

| | | | | |
|---|---|---|---|---|
| 4,025,777 | A * | 5/1977 | Hayakawa | 362/250 |
| 5,353,211 | A * | 10/1994 | Merko | 362/232 |
| 5,581,448 | A * | 12/1996 | Harwood | 362/147 |
| 6,095,671 | A * | 8/2000 | Hutain | 362/264 |
| 6,234,644 | B1 * | 5/2001 | Kotovsky et al. | 362/147 |
| 6,357,891 | B1 * | 3/2002 | Newbold et al. | 362/147 |
| 6,474,846 | B1 * | 11/2002 | Kelmelis et al. | 362/365 |
| 6,568,826 | B1 * | 5/2003 | Kotovsky | 362/147 |
| 2003/0086259 | A1 * | 5/2003 | Kotovsky | 362/147 |

* cited by examiner

*Primary Examiner*—John Anthony Ward
(74) *Attorney, Agent, or Firm*—Ansel M. Schwartz

(57) ABSTRACT

An apparatus for lighting in a building structure. The apparatus includes a lighting fixture having at least two lamps. The apparatus includes a one-piece layer having a plurality of holes aligned with the respective lamps through which light from the lamps pass. A panel for a mounted lighting fixture having at least two lamps in a building structure. A method of lighting a building. A method for forming a panel. A method for forming a panel.

12 Claims, 4 Drawing Sheets

METHOD AND APPARATUS FOR LIGHTING WITH A ONE-PIECE PANEL HAVING A PLURALITY OF HOLES

FIELD OF THE INVENTION

The present invention is related to a panel for two or more lamps that is one piece. More specifically, the present invention is related to a lighting panel for two or more lights that is one piece that allows the lamps to be positioned at a desired depth in shields about holes in the panel.

BACKGROUND OF THE INVENTION

The placement of lighting in buildings is often given aesthetic considerations, besides the functional considerations of affording lighting to areas within a building. One way to achieve an aesthetically pleasing appearance for lighting fixtures is for the placement of the lighting fixture to be as unobtrusive as possible. That is, the lighting fixture appears to be integral and part of the ceiling or wall or floor in which it is placed. In the past, single hole panels that are molded and made of plaster of paris have been used to cover lamps but to appear as part of the wall or ceiling that they are in. The present invention extends this technique to panels having more than one hole which also allow for the placement of the lamps at a desired depth with respect to the holes in the panel.

SUMMARY OF THE INVENTION

The present invention pertains to an apparatus for lighting in a building structure. The apparatus comprises a lighting fixture having at least two lamps. The apparatus comprises a one-piece layer having a plurality of holes adapted to be aligned with the respective lamps through which light from the lamps pass.

The present invention pertains to a panel for a mounted lighting fixture having at least two lamps in a building structure. The apparatus comprises a one-piece layer having a plurality of holes adapted to be aligned with respective lamps through which light from the lamps pass.

The present invention pertains to a method of lighting a building. The method comprises the steps of placing a one-piece panel having holes on a lighting fixture having lamps so the holes align with the lamps and light from the lamps can pass through the holes. The method comprises the steps of securing the panel to the building structure.

The present invention pertains to a method for forming a panel. The method comprises the steps of introducing material into a mold having at least two lands that define holes in the material when the material has solidified. The method comprises the steps of letting the material solidify. The method comprises the steps of separating the solidified material from the mold.

The present invention pertains to a method for forming a panel. The method comprises the steps of cutting a first hole in a layer. The method comprises the steps of cutting a second hole in a layer.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
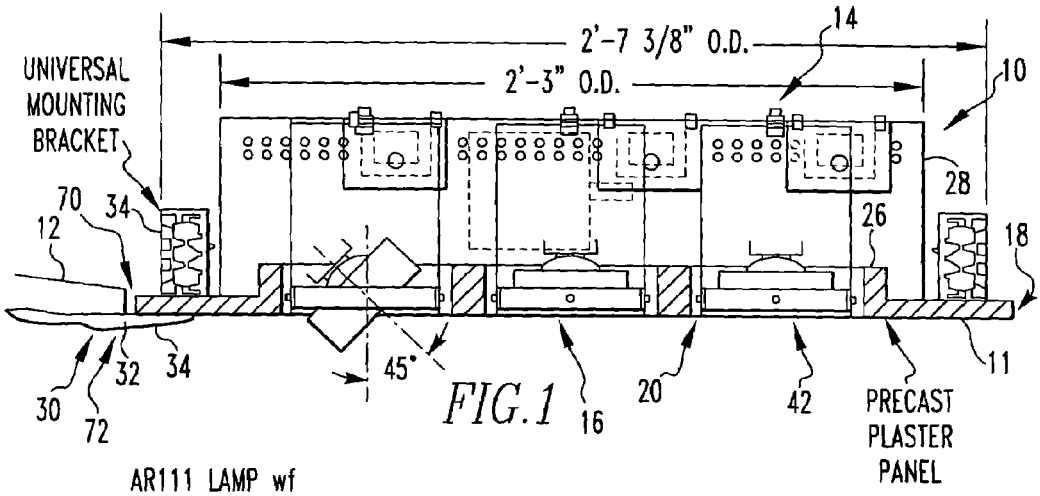
FIG. 1 is a schematic representation of a front view of the present invention.
Figure 2:
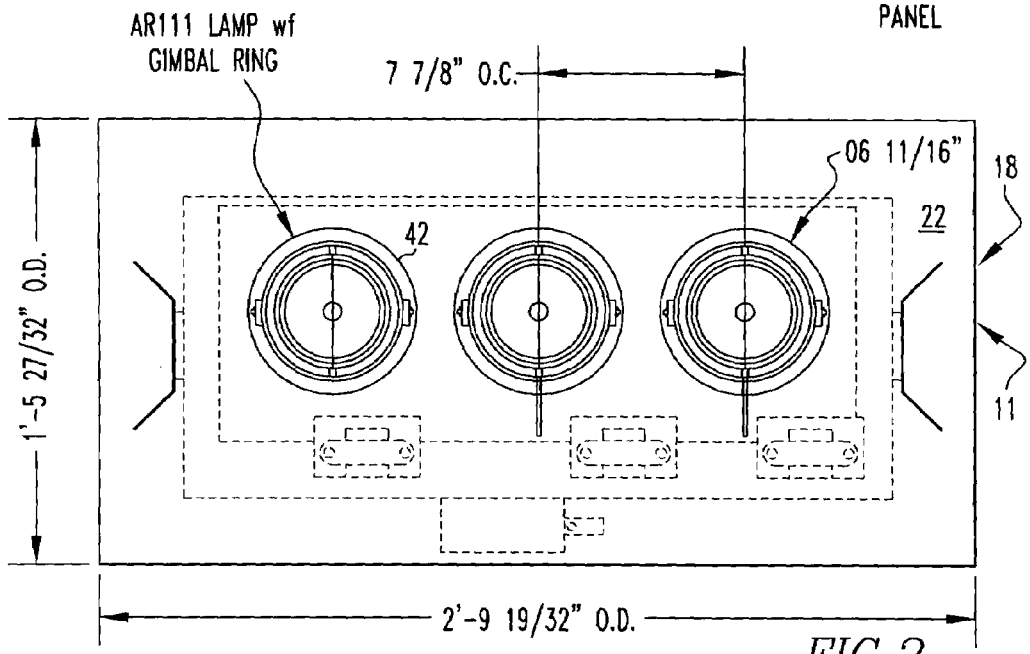
FIG. 2 is a schematic representation of a bottom view of the present invention.
Figure 3:
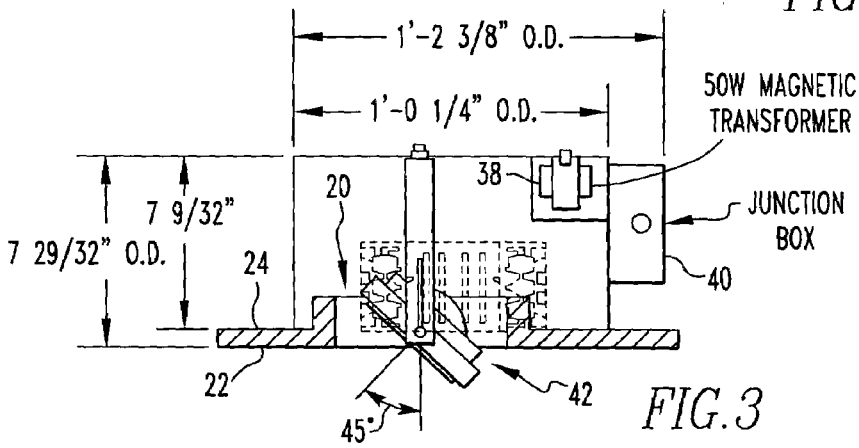
FIG. 3 is a schematic representation of an end view of the present invention.

Referring now to the drawings wherein like reference numerals refer to similar or identical parts throughout the several views, and more specifically to FIGS. 1–3 thereof, there is shown an apparatus 10 for lighting in a building structure 12. The apparatus 10 comprises a lighting fixture 14 having at least two lamps 16. The apparatus 10 comprises a one-piece layer 18 having a plurality of holes 20 adapted to be aligned with the respective lamps 16 through which light from the lamps 16 pass. The lamps 16 can be low voltage lamps or line voltage lamps.

Preferably, the layer 18 has a front surface 22 and a back surface 24, and the layer 18 has a shield 26 extending from the back surface 24 disposed about each hole. The lamps 16 are positioned at a desired depth in the shields 26. The fixture 14 preferably includes a housing 28 which holds the lamps 16. Preferably, the apparatus 10 includes a transformer 38 connected to the lamps 16 and a junction box 40 for providing electricity to the lamps 16. The fixture 14 preferably includes gimbal rings 42 in which the lamps 16 are disposed.

Figure 4:
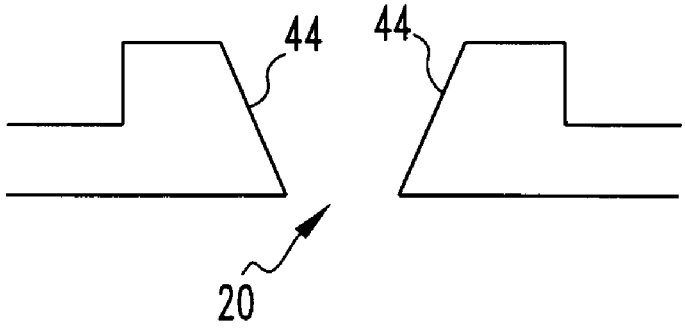
FIGS. 4, 5, and 6 are schematic representations of edges of holes extending outward, inward and straight up, respectively, from a front surface of a panel.
Figure 5:
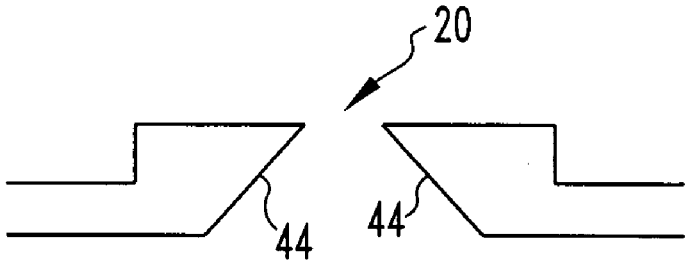
Figure 6:
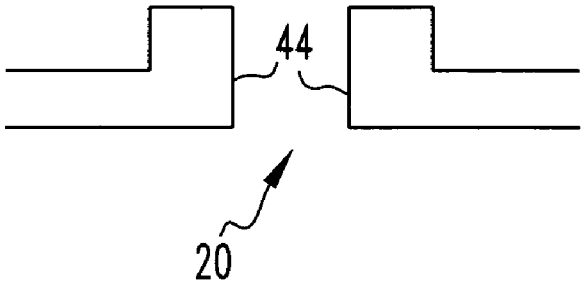

Preferably, the apparatus 10 includes means for merging the layer 18 to the building structure 12. The means for merging preferably includes tape 32 that is positioned on the building structure 12 and the layer 18 to hold the layer 18 to the building structure 12. Preferably, the merging means 30 includes a universal mounting bracket 34 to mount the layer 18 to the building structure 12. The merging means 30 preferably includes spackle 36 that is placed over the tape 32 to cover the tape 32 and any seam between the building structure 12 and the layer 18. Preferably, the holes 20 have edges 44 which are straight, or edges 44 which angle inwards or edges 44 which angle outwards, as shown in FIGS. 4–6. The holes 20 can be symmetrical or asymmetrical.

Figure 7:
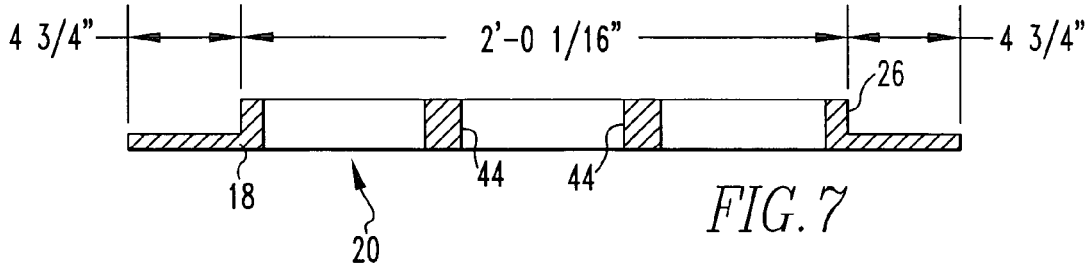
FIG. 7 is a schematic representation of a front view of a panel.
Figure 8:
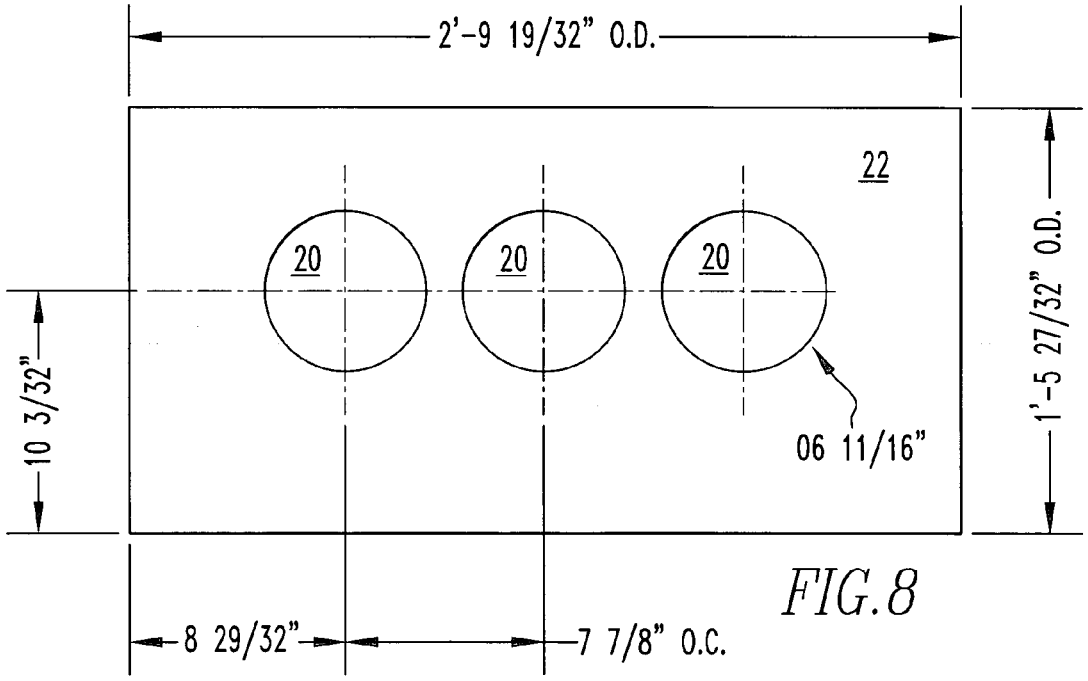
FIG. 8 is a schematic representation of a bottom view of a panel.
Figure 9:
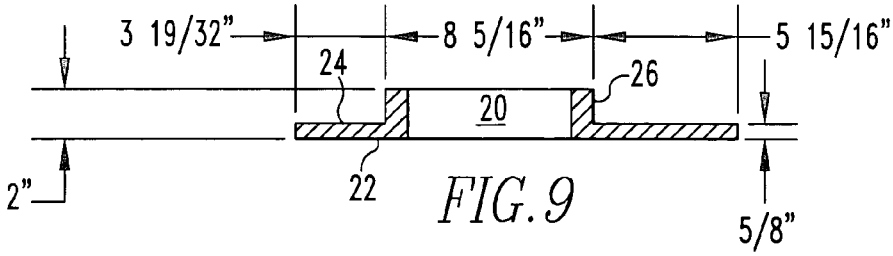
FIG. 9 is a schematic representation of an end view of a panel.

The present invention pertains to a panel 11 for a mounted lighting fixture 14 having at least two lamps 16 in a building structure 12, as shown in FIGS. 7–9. The panel 11 comprises a one-piece layer 18 having a plurality of holes 20 adapted to be aligned with respective lamps 16 through which light from the lamps 16 pass.

Preferably, the layer 18 has a front surface 22 and a back service, and the layer 18 has a shield 26 extending from the back surface 24 disposed about each hole. The layer 18 can be made of glass, plaster of paris, corian, marble, granite, wood, plastic, metal or ceramic.

The present invention pertains to a method of lighting a building. The method comprises the steps of placing a one-piece panel 11 having holes 20 on a lighting fixture 14 having lamps 16 so the holes 20 align with the lamps 16 and light from the lamps 16 can pass through the holes 20. The method comprises the steps of securing the panel 11 to the building structure 12.

Preferably, there is the step of adjusting the height of lamps 16 in shields 26 of the panel 11 about the holes 20. The securing step preferably includes the step of taping the panel 11 to the building structure 12 and spackling over the tape 32.

Figure 12:
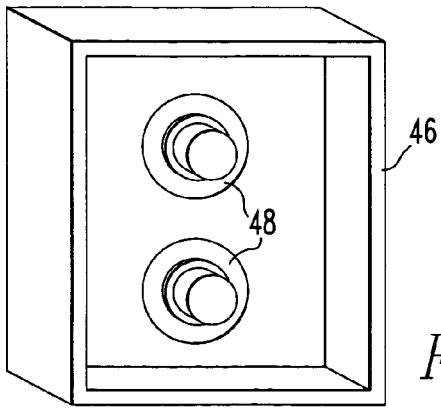
FIG. 12 is a schematic representation of a mold.

The present invention pertains to a method for forming a panel 11. The method comprises the steps of introducing material into a mold 46 having at least two lands 48 that define holes 20 in the material when the material has solidified, as shown in FIG. 12. The method comprises the steps of letting the material solidify. The method comprises the steps of separating the solidified material from the mold 46.

The present invention pertains to a method for forming a panel 11. The method comprises the steps of cutting a first hole in a layer 18. The method comprises the steps of cutting a second hole in a layer 18.

In the operation of the invention, a one-piece panel 11 having holes 20 is formed by either being cut or molded. In the case of the panel 11 formed from a mold 46, as shown in figure 12, a material such as plaster of paris is poured into a mold 46 having two or more lands 48 in it of a desired shape. The lands 48 can be angled outwards, inwards or straight, depending on how the ultimate end shape of the hole 20 is desired. When the plaster has solidified, panel 11 is separated from the mold 46 and the holes 20 are formed where the lands 48 have been. If the panel 11 is to be formed by cutting, a solid piece of material, such as marble, granite, or wood, has holes 20 drilled or cut out, where desired in it. Shields 26, are then attached by adhesive to the back surface 24 of the panel 11 about the holes 20.

Once the panel 11 is formed, it is placed on a lighting fixture 14 with holes 20 of the panel 11 in alignment with lamps 16 of the lighting fixture 14, as shown in FIGS. 1, 2 and 3. The lamps 16 are positioned in the holes 20 and at a desired depth in the holes 20. To assist in the alignment process, the panel 11 can have alignment holes. The housing 28 can have pins which fit into the alignment holes to make sure the panel 11 is properly positioned with the housing. Alternatively, the housing 28 can have the alignment holes and the pins extend from the back surface 24 of the panel 11. The pins or holes can be placed or formed in the panel during the molding or cutting process.

The lamps 16 can be aligned so they are along the front surface 22 of the panel 11, or they can be positioned so that they are recessed back from the front surface 22. This is accomplished because the lamps 16 are supported by the fixture 14 and not by the panel 11 itself. The holes 20 are large enough that the lamps 16 which are in gimbal rings 42 can be swivelled to any desired position. For aesthetic purposes, the edges 44 of the holes 20 can be angled inwards, outwards or straight up from a front surface 22, as shown in FIGS. 4, 5, and 6. The fixture 14 includes transformers 38 and junction boxes 40 for providing electricity to the lamps 16, as is well-known in the art, as shown in FIGS. 1 and 3. The gimbal rings 42 can be with yokes or without yokes. The gimbal rings 42 can be locked, as described in U.S. Pat. No. 6,170,965, incorporated by reference herein.

The panel 11 can be attached to the fixture 14 before or after the fixture is mounted to the building structure. The panel 11 is attached to the housing 28 with clips or clip board screws. Sheet rock screws can be used to attach the panel 11 to the building structure, that is, for instance, made of gypsum board. The load of the panel 11 is preferably supported by the wall or ceiling. The fixture is preferably supported by the building structure, as is well known in the art.

Once the panel 11 is in place with a fixture 14, the fixture 14 and panel 11 are, placed into the building structure 12, such as a ceiling or a wall, and mounted to the building structure 12. The panel 11 which is attached to the fixture 14 has a universal mounting bracket 34 on each side which is used to mount to the building structure 12 and be held by it.

It should be noted that the panel 11 can be connected with the lighting fixture 14 after lighting fixture 14 has first been connected to the building structure 12. This depends on the choice of installation.

Figure 11:
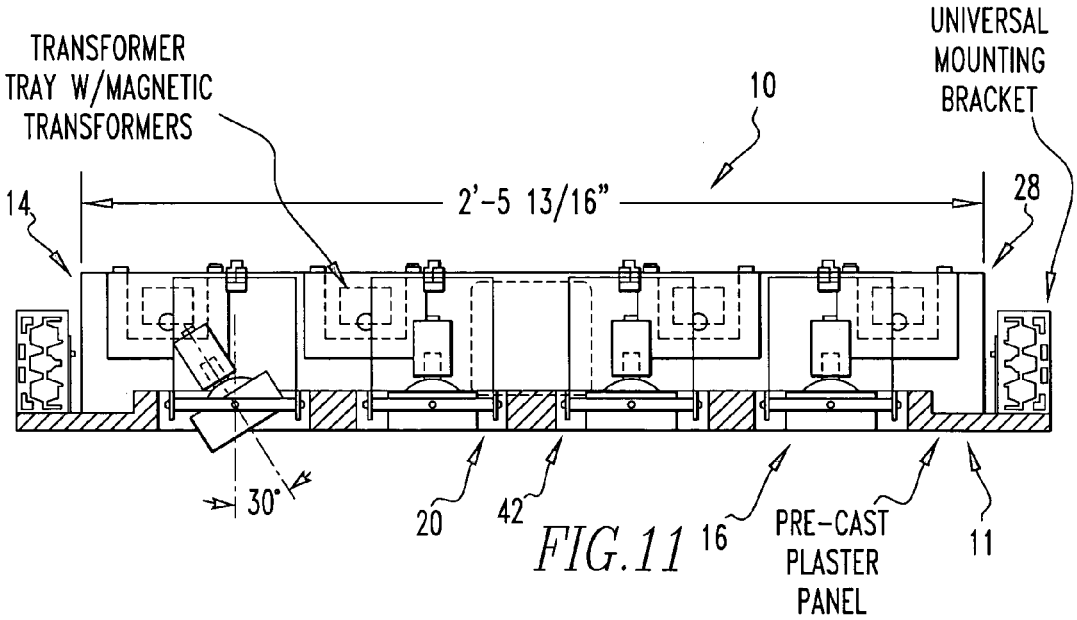
FIG. 11 is a schematic representation of a front view of a 4 lamp embodiment of the present invention.
Figure 10:
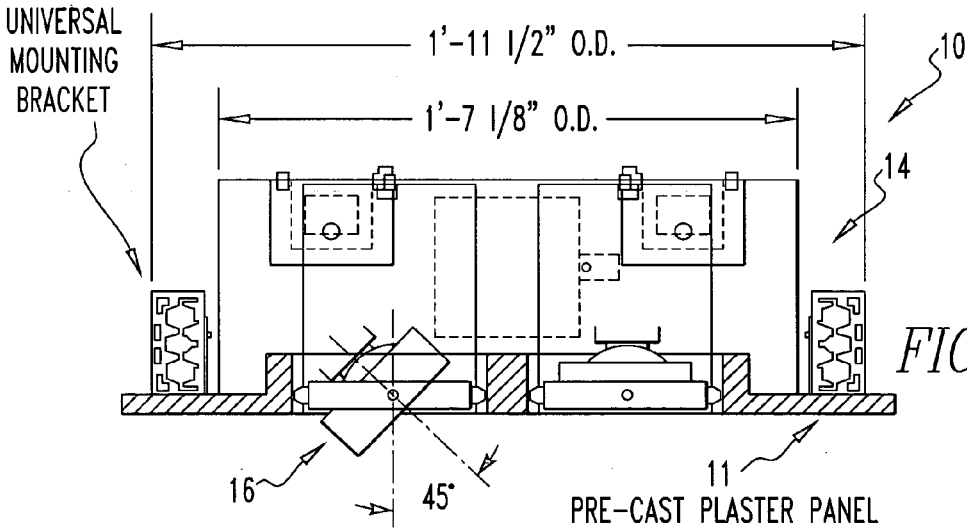
FIG. 10 is a schematic representation of a front view of a 2 lamp embodiment of the present invention.

The holes 20 can be symmetric or asymmetric, depending on the aesthetic presentation desired. It is common for the panel 11 to have two to four holes 20, depending on the number of lamps 16 in the fixture 14, as shown in FIGS. 1, 10 and 11.

Once the fixture 14 and panel 11 is in place, tape 32 is placed along the seams 70 defined by the building structure 12 and the panel 11 and placed in contact with the building structure 12 and panel 11 to cover over any seams. Spackle 36 is then placed over the tape 32 to cover any evidence of its presence and make a clean face 72 on the building structure 12 for appearance purposes, as shown in FIG. 1.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for lighting in a building structure comprising:

a lighting fixture having at least two lamps;

a one-piece layer having a plurality of holes aligned with the respective lamps through which light from the lamps pass, the layer fitting into the building structure and defining a seam between the building structure and the layer, the holes having edges which are straight, or edges which angle inwards or edges which angle outwards, the edges extending inwardly toward the fixture from a front surface of the layer, the layer having a smooth flat front surface across the entire layer; and spackle disposed over the seam between the building structure and the layer to cover any evidence of the seam and define a clean flat face across the building structure and the entire layer.

2. An apparatus as described in claim 1 wherein the layer has a front surface and a back surface, and the layer has a shield extending from the back surface disposed about each hole, the lamps are position at a desired depth in the shields.

3. An apparatus as described in claim 2 wherein the fixture includes a housing which holds the lamps.

4. An apparatus as described in claim 3 including tape that is positioned on the building structure and the layer to hold the layer to the building structure.

5. An apparatus as described in claim 4 including a universal mounting bracket to mount the layer to the building structure.

6. An apparatus as described in claim 5 including a transformer connected to the lamps and a junction box for providing electricity to the lamps.

7. An apparatus as described in claim 6 wherein the fixture includes gimbal rings in which the lamps are disposed.

8. An apparatus as described in claim 7 wherein the holes are symmetrical or asymmetrical.

9. A panel as described in claim 7 wherein the layer is made of glass, plaster of paris, corian, marble, granite, wood, metal or ceramic.

10. A method of lighting a building comprising the steps of:

placing a one-piece panel having holes on a lighting fixture having lamps so the holes align with the lamps and light from the lamps can pass through the holes, the holes having edges which are straight, or edges which angle inwards or edges which angle outwards, the edges extending inwardly toward the fixture from a front surface of the layer, the layer having a smooth flat outer face across the entire layer;

fitting the panel into the building structure;

securing the panel to the building structure so the load of the panel is supported by the building structure; and spackling over a seam defined between the panel and the building structure to cover any evidence of the seam to define a clean flat face across the building structure and the entire layer.

11. A method as described in claim 10 including the step of adjusting the height of lamps in shields of the panel about the holes.

12. A method as described in claim 11 wherein the spackling step includes the step of taping over a seam between the panel and the building structure and spackling over the tape.

* * * * *